US010100390B2

(12) United States Patent
Kadokura et al.

(10) Patent No.: US 10,100,390 B2
(45) Date of Patent: Oct. 16, 2018

(54) HEAT-RESISTANT MOLYBDENUM ALLOY

(71) Applicant: A.L.M.T. Corp., Minato-ku, Tokyo (JP)

(72) Inventors: Takanori Kadokura, Toyama (JP); Hidenobu Nishino, Toyama (JP); Ayuri Tsuji, Toyama (JP); Shigekazu Yamazaki, Toyama (JP); Akihiko Ikegaya, Toyama (JP)

(73) Assignee: A.L.M.T. Corp., Minato-ku, Tokyo (JP)

( * ) Notice: Subject to any disclaimer, the term of this patent is extended or adjusted under 35 U.S.C. 154(b) by 704 days.

(21) Appl. No.: 14/531,663

(22) Filed: Nov. 3, 2014

(65) Prior Publication Data

US 2015/0056408 A1 Feb. 26, 2015

Related U.S. Application Data

(62) Division of application No. 14/130,204, filed as application No. PCT/JP2013/056734 on Mar. 12, 2013.

(30) Foreign Application Priority Data

Jun. 7, 2012 (JP) ..... 2012-129832
Jan. 10, 2013 (JP) ..... 2013-002686

(51) Int. Cl.

| | |
|---|---|
| ***C22C 27/04*** | (2006.01) |
| ***C22C 38/50*** | (2006.01) |
| ***B21C 25/02*** | (2006.01) |
| ***C22C 1/04*** | (2006.01) |
| ***C22C 32/00*** | (2006.01) |
| *C22C 38/44* | (2006.01) |
| *B22F 3/17* | (2006.01) |
| *B22F 3/20* | (2006.01) |

(52) U.S. Cl.

CPC ..... *C22C 27/04* (2013.01); *B21C 25/025* (2013.01); *C22C 1/045* (2013.01); *C22C 1/0491* (2013.01); *C22C 32/0031* (2013.01); *C22C 32/0052* (2013.01); *C22C 38/50* (2013.01); *B22F 3/17* (2013.01); *B22F 3/20* (2013.01); *C22C 38/44* (2013.01); *Y10T 428/12819* (2015.01); *Y10T 428/12826* (2015.01); *Y10T 428/12847* (2015.01); *Y10T 428/24355* (2015.01); *Y10T 428/265* (2015.01)

(58) Field of Classification Search

CPC ..... C22C 27/04; C22C 38/44; C22C 38/50
See application file for complete search history.

(56) References Cited

U.S. PATENT DOCUMENTS

| | | | | |
|---|---|---|---|---|
| 5,595,616 | A | 1/1997 | Berczik | |
| 5,693,156 | A | 12/1997 | Berczik | |
| 6,652,674 | B1 | 11/2003 | Woodard et al. | |
| 7,767,138 | B2 | 8/2010 | Jehanno et al. | |
| 7,806,995 | B2 | 10/2010 | Jehanno | |
| 2004/0166359 | A1* | 8/2004 | Fukaya | C23C 4/10 428/639 |
| 2008/0128472 | A1 | 6/2008 | Park et al. | |
| 2009/0011266 | A1 | 1/2009 | Cochran et al. | |
| 2009/0290685 | A1* | 11/2009 | Aoyama | C22C 1/045 378/144 |

FOREIGN PATENT DOCUMENTS

| | | | |
|---|---|---|---|
| EP | 0804627 | A1 | 11/1997 |
| EP | 1918059 | A1 | 5/2008 |
| JP | 10-512329 | A | 11/1998 |
| JP | 2008-114258 | A | 5/2008 |
| JP | 2008-246553 | A | 10/2008 |
| JP | 4325875 | B2 | 9/2009 |

OTHER PUBLICATIONS

Walser, Hermann, and D. J. Shields. "Traditional and emerging applications of molybdenum metal and its alloys." IMOA Newsletter, Jul. (2007).*

"Powder and Powder Metallurgy Handbook", Nov. 2010, edited by the Japan Society of Powder and Powder Metallurgy, published by Uchida Rokakuho, (first edition), pp. 291-295.

International Search Report for PCT/JP2013/056734 dated Jun. 18, 2013.

Schneibel et al., "Optimization of Mo—Si—B Intermetallics", Mat. Res. Soc. Symp. Proc., Materials Research Society, 2003, vol. 753, 6 total pages, XP009050743.

Communication dated Jun. 24, 2014, issued by the European Patent Office in corresponding Application No. 13801113.5.

* cited by examiner

*Primary Examiner* — Jessee R Roe
*Assistant Examiner* — Jophy S. Koshy
(74) *Attorney, Agent, or Firm* — Sughrue Mion, PLLC

(57) ABSTRACT

A heat-resistant member comprising a molybdenum alloy that comprises a first phase containing Mo as a main component and a second phase comprising a Mo—Si—B-based intermetallic compound particle phase, wherein the balance is an inevitable impurity and wherein the Si content is 0.05 mass % or more and 0.80 mass % or less and the B content is 0.04 mass % or more and 0.60 mass % or less. The member may be coated.

6 Claims, 1 Drawing Sheet

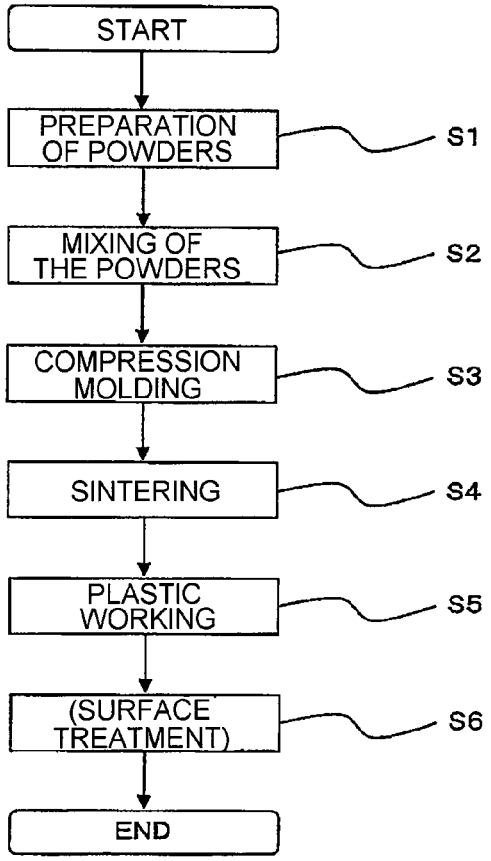
START
PREPARATION OF POWDERS
S1
MIXING OF THE POWDERS
S2
COMPRESSION MOLDING
S3
SINTERING
S4
PLASTIC WORKING
S5
(SURFACE TREATMENT)
S6
END

HEAT-RESISTANT MOLYBDENUM ALLOY

This application is a Divisional of U.S. application Ser. No. 14/130,204, filed Dec. 30, 2013, which is a is a National Stage of International Application No. PCT/JP2013/056734 filed Mar. 12, 2013, claiming priority based on Japanese Patent Application Nos. 2012-129832 filed Jun. 7, 2012 and 2013-002686 filed Jan. 10, 2013, the contents of all of which are incorporated herein by reference in their entirety.

TECHNICAL FIELD

This invention relates to a heat-resistant molybdenum alloy suitable for a plastic working tool for use in a high-temperature environment, particularly for a hot extrusion die.

BACKGROUND ART

In recent years, there has been required a heat-resistant alloy excellent in strength and ductility which is suitable for prolonging the life of a plastic working tool for use in a high-temperature environment, such as a hot extrusion die, a seamless tube manufacturing piercer plug, or an injection molding hot runner nozzle.

For this requirement, conventionally, molybdenum (Mo) which is relatively easy to obtain and is excellent in plastic workability and heat resistance has been cited as a candidate. However, in the case of a pure molybdenum material to which no specific element is intentionally added, it cannot be said to be a material suitable for the above-mentioned use because its strength is low.

Accordingly, the strength of a molybdenum material is required to be improved.

As a method of improving the strength of the molybdenum material, there is known a method of adding a different kind of material to molybdenum.

As the method of adding the different kind of material, there is well known a method of adding carbide particles such as TiC particles (Patent Document 1).

On the other hand, in this Mo-carbide two-phase alloy, because of its activity, giant columnar crystals are often formed by abnormal grain growth of the added carbide. For example, in the case of the Ti carbide, the Ti carbide added to Mo forms a solid solution with Mo, wherein the Ti carbide has a TiC particle inside, forms a thin (Mo, Ti) C solid solution phase around the particle, and further forms strong bonding to a Mo phase, which is known as a so-called cored structure (Non-Patent Document 1). However, TiC has a wide nonstoichiometric composition range of C/Ti=0.5 to 0.98. Therefore, the compositions and thicknesses of (Mo, Ti) C intermediate phases differ from each other so that when the (Mo, Ti) C intermediate phases are brought into contact with each other, the grain growth may occur due to stabilization by rediffusion of the respective elements.

The presence of such giant columnar crystals may be a major cause for reduction in strength. It is difficult to control the presence, size, and so on of such giant columnar crystals, thus leading to variation in the strength of the entire material. Also in the case of Zr or Hf which is an element in the same group as Ti, its carbide has crystal structure and nonstoichiometric composition ranges similar to those of TiC and thus forms giant columnar crystals like TiC as described above.

On the other hand, there is also known a method of adding an intermetallic compound of molybdenum as an additive.

As such an intermetallic compound, there is known a Mo—Si—B-based intermetallic compound (e.g. $Mo_5SiB_2$) which is an intermetallic compound of molybdenum, silicon, and boron. There is known a method of adding this intermetallic compound to molybdenum, thereby significantly improving the strength in high temperatures (Patent Document 2, Patent Document 3).

This is caused by the fact that $Mo_5SiB_2$ has a high hardness. If only the strengths are compared, the material added with $Mo_5SiB_2$ is a material much superior to that of Patent Document 1.

However, if high-hardness $Mo_5SiB_2$ is added to Mo, the ductility becomes extremely low particularly at 1000° C. or less and becomes approximately zero at room temperature.

Therefore, there has been a problem that the material added with $Mo_5SiB_2$ cannot be said to be a material which is also excellent in ductility over a wide temperature range so that its use is limited.

PRIOR ART DOCUMENT

Patent Document

Patent Document 1: JP-A-2008-246553
Patent Document 2: JP-A-H10-512329
Patent Document 3: Japanese Patent (JP-B) No. 4325875

Non-Patent Document

Non-Patent Document 1: edited by The Japan Society of Powder and Powder Metallurgy, "Powder and Powder Metallurgy Handbook", published by Uchida Rokakuho, (first edition) pp. 291-295, Nov. 10, 2010

SUMMARY OF THE INVENTION

Problem to be Solved by the Invention

As described above, attempts have been made to add various additives to Mo for improving the strength and heat resistance. However, it is a current state that the conditions, particularly the temperature range, where the obtained materials can exhibit their properties are limited and thus that there is no molybdenum material that can satisfy both the strength and ductility over a wide temperature range.

This invention has been made in view of the above-mentioned problem and it is an object of this invention to provide a heat-resistant molybdenum alloy having a strength equal to or greater than conventional and yet having ductility over a wide temperature range.

Means for Solving the Problem

In order to solve the above-mentioned problem, the present inventors have made studies on a material to be added to Mo and, as a result, have again made studies on the addition amount and shape of Mo—Si—B-based intermetallic compound particles which have conventionally been considered to sacrifice the ductility in exchange for the strength, and on the metal structure of a Mo metal phase.

As a result, the present inventors have found that a molybdenum alloy that can satisfy both the strength and ductility over a wide temperature range, which has conventionally been considered impossible, can be obtained by setting the addition amount in a predetermined range, and have completed this invention.

According to a first aspect of the present invention, there is provided a heat-resistant molybdenum alloy characterized by comprising: a first phase containing Mo as a main component; and a second phase comprising a Mo—Si—B-based intermetallic compound particle phase, wherein the Si content is 0.05 mass % or more and 0.80 mass % or less and the B content is 0.04 mass % or more and 0.60 mass % or less.

According to a second aspect of the present invention, there is provided a heat-resistant member characterized by comprising the heat-resistant molybdenum alloy according to the first aspect. The heat-resistant member is one of a high-temperature industrial furnace member, a hot extrusion die, a firing floor plate, a piercer plug, a hot forging die, and a friction stir welding tool for example.

According to a third aspect of the present invention, there is provided a heat-resistant coated member characterized in that a coating film made of one or more kinds of elements selected from group 4A elements, group 3B elements, group 4B elements other than carbon, and rare earth elements of the periodic table or an oxide of at least one or more kinds of elements selected from these element groups is coated to a thickness of 10 μm to 300 μm on a surface of the heat-resistant molybdenum alloy according to the frist aspect or the heat-resistant member according to the second aspect, wherein the coating film has a surface roughness of Ra 20 μm or less and Rz 150 μm or less.

According to a fourth aspect of the present invention, there is provided a heat-resistant coated member characterized in that a coating film made of one or more kinds of elements selected from group 4A elements, group 5A elements, group 6A elements, group 3B elements, group 4B elements other than carbon, and rare earth elements of the periodic table or an oxide, a carbide, a nitride, or a carbonitride of at least one or more kinds of elements selected from these element groups is coated to a thickness of 1 μm to 20 μm on a surface of the heat-resistant molybdenum alloy according to the first aspect or the heat-resistant member according to the second aspect.

Effect of the Invention

According to this invention, it is possible to provide a heat-resistant molybdenum alloy having a strength equal to or greater than conventional and yet having ductility over a wide temperature range.

BRIEF DESCRIPTION OF THE DRAWINGS

FIG. 1 is a flowchart showing a method of manufacturing a heat-resistant molybdenum alloy of this invention.

MODE FOR CARRYING OUT THE INVENTION

Hereinbelow, preferred embodiments of this invention will be described in detail with reference to the drawings.

First, a first embodiment of this invention will be described.

<Heat-Resistant Molybdenum Alloy Composition>

First, the composition of a heat-resistant molybdenum alloy of this invention will be described.

The heat-resistant molybdenum alloy of the first embodiment of this invention has a structure comprising a first phase composed mainly of Mo and a second phase comprising a Mo—Si—-B-based intermetallic compound particle phase, wherein the second phase is dispersed in the first phase.

Hereinbelow, the respective phases and materials forming them will be described.

<First Phase>

The first phase is a phase containing Mo as a main component. Herein, the main component represents a component whose content is highest (the same shall apply hereinafter).

Specifically, the first phase is composed of, for example, Mo and inevitable impurities.

<Second Phase>

The second phase is a phase comprising a Mo—Si—B-based intermetallic compound particle phase. For example, $Mo_5SiB_2$ is cited as a Mo—Si—B-based intermetallic compound particle.

<Composition Ratio>

The heat-resistant molybdenum alloy of the first embodiment of this invention has, as described above, the second phase comprising the Mo—Si—B-based intermetallic compound particle phase and thus contains Si and B.

Herein, in order to enhance the strength of the material and to prevent significant reduction in the ductility of the material, it is preferable that, in the heat-resistant molybdenum alloy, the Si content be 0.05 mass % or more and 0.80 mass % or less and the B content be 0.04 mass % or more and 0.60 mass % or less.

This is because if the Si content is less than 0.05 mass % or the B content is less than 0.04 mass %, the strength improving effect cannot be obtained while if the Si content exceeds 0.80 mass % or the B content exceeds 0.60 mass %, not only the plastic workability but also the ductility is extremely reduced, and therefore, an obtained alloy departs from the spirit of this invention and cannot be a material that can be used over a wide temperature range.

In terms of enhancing the strength of the material and preventing significant reduction in the ductility of the material, it is more preferable that the Si content be 0.15 mass % or more and 0.42 mass % or less and that the B content be 0.12 mass % or more and 0.32 mass % or less and it is further preferable that the Si content be 0.20 mass % or more and 0.37 mass % or less and that the B content be 0.16 mass % or more and 0.28 mass % or less.

When the heat-resistant molybdenum alloy contains $Mo_5SiB_2$ as Mo—Si—B-based intermetallic compound particles, its content is preferably 1 to 15 mass %.

<Structure>

The heat-resistant molybdenum alloy of the first embodiment of this invention has, as described above, the structure in which the second phase comprising the Mo—Si—B-based intermetallic compound particle phase is dispersed in the first phase containing Mo as the main component, wherein the aspect ratio, which is a ratio of a major axis to a minor axis (major axis/minor axis), of matrix crystal grains in the heat-resistant alloy, i.e. crystal grains of the first phase, is preferably 1.5 or more and 1000 or less.

This is because if the aspect ratio is less than 1.5, the strength improving effect cannot be sufficiently obtained while if it is more than 1000, the reduction ratio becomes very high so that the productivity and cost are degraded, and in addition, the ductility is lowered.

Herein, the aspect ratio represents a value obtained by taking a photograph of a test piece cross section using an optical microscope, drawing an arbitrary straight line in a material thickness direction on the photograph, measuring the length and the average width in the thickness direction of each of crystal grains, crossing this straight line, of a Mo metal phase, and calculating (length/average width in thickness direction).

On the other hand, in order to enhance the strength of the material and to prevent significant reduction in the ductility of the material, the average particle diameter of the Mo—Si—B-based intermetallic compound particle phase in the heat-resistant alloy is preferably 0.05 μm or more and 20 μm or less.

This is because it is difficult to industrially produce a Mo—Si—B-based intermetallic compound particle powder with an average particle diameter of less than 0.05 μm and, further, if the average particle diameter exceeds 20 μm, the ductility decreases and the density of a sintered body is difficult to increase.

Further, in terms of ensuring the ductility, the average particle diameter is more preferably 0.05 μm or more and 5 μm or less and further preferably 0.05 μm or more and 1.0 μm or less.

Herein, the average particle diameter is an average value obtained by taking an enlarged photograph of 500 to 10000 magnifications according to the size of particles and measuring the major axes of at least 50 arbitrary particles on the photograph.

<Inevitable Impurities>

The heat-resistant molybdenum alloy according to the first embodiment of this invention may contain inevitable impurities in addition to the above-mentioned essential components.

As the inevitable impurities, there are metal components such as Fe, Ni, and Cr, C, N, O, and so on.

<Coating Film>

While the heat-resistant molybdenum alloy according to the first embodiment of this invention has the above-mentioned structure, when it is used, for example, as a friction stir welding tool, a coating film may be formed on its surface in order to prevent the heat-resistant molybdenum alloy from being oxidized or welded to a welding object depending on the temperature during use.

Specifically, when, for example, this heat-resistant alloy is used as a firing floor plate, it is preferable that, in order to improve the mold releasability after use or prevent oxidation of the floor plate during use, the surface of the heat-resistant alloy be coated with a coating film having a thickness of 10 μm to 300 μm and made of one or more kinds of elements selected from group 4A elements, group 3B elements, group 4B elements other than carbon, and rare earth elements of the periodic table or an oxide of at least one or more kinds of elements selected from these element groups.

In this case, the thickness of the coating layer is preferably 10 μm to 300 μm. This is because if the thickness of the coating layer is less than 10 μm, the above-mentioned effect cannot be expected while if it is more than 300 μm, excessive stress occurs, resulting in stripping of the film, and therefore, the effect cannot be expected likewise.

The surface roughness of the coating layer is preferably Ra 20 μm or less and Rz 150 μm or less. This is because if the coating layer exceeds the respective numerical values, the shape of fired products is deformed so that the yield is reduced.

The composition of the coating layer is preferably $Al_2O_3$, $ZrO_2$, $Y_2O_3$, $Al_2O_3$—$ZrO_2$, $ZrO_2$—$Y_2O_3$, $ZrO_2$—$SiO_2$, or the like alone or in combination.

On the other hand, a coating method is not particularly limited and the coating film can be formed by a known method. Thermal spraying can be cited as a typical coating method.

On the other hand, when this heat-resistant alloy is used, for example, as a friction stir welding tool, it is preferable that, in order to prevent the heat-resistant alloy from being welded to a welding object depending on the temperature during use, the surface of the heat-resistant alloy be coated with a coating film made of one or more kinds of elements selected from group 4A elements, group 5A elements, group 6A elements, group 3B elements, group 4B elements other than carbon, and rare earth elements of the periodic table or an oxide, a carbide, a nitride, or a carbonitride of at least one or more kinds of elements selected from these element groups. The thickness of the coating layer is preferably 1 μm to 20 μm. This is because if the thickness of the coating layer is less than 1 μm, the above-mentioned effect cannot be expected while if it is 20 μm or more, excessive stress occurs, resulting in stripping of the film, and therefore, the effect cannot be expected likewise.

In this case, as the coating layer, there can be cited a layer of TiC, TiN, TiCN, ZrC, ZrN, ZrCN, VC, VN, VCN, CrC, CrN, CrCN, TiAlN, TiSiN, or TiCrN, or a multilayer film including at least one or more of these layers.

A coating layer forming method is not particularly limited and the coating film can be formed by a known method. As a typical coating film forming method, there can be cited a PVD (Physical Vapor Deposition) treatment such as sputtering, a CVD (Chemical Vapor Deposition) treatment for coating by chemical reaction, or the like.

The foregoing are the conditions of the heat-resistant molybdenum alloy.

<Manufacturing Method>

Next, a method of manufacturing the heat-resistant molybdenum alloy of the first embodiment of this invention will be described with reference to FIG. 1.

The method of manufacturing the heat-resistant molybdenum alloy of the first embodiment of this invention is not particularly limited as long as it can manufacture the heat-resistant molybdenum alloy that satisfies the above-mentioned conditions. However, the following method shown in FIG. 1 can be given as an example.

First, raw material powders are prepared (S1 in FIG. 1).

Herein, as the raw materials, there can be cited a Mo powder and a Mo—Si—B-based intermetallic compound particle powder. However, as long as a first phase and a second phase can be obtained in the range of this invention, starting raw material powders may be any combination of, for example, a pure metal (Mo, Si, B) and a compound ($Mo_5SiB_2$, MoB, $MoSi_2$, or the like).

Among them, with respect to the Mo powder, while the powder properties such as the particle diameter and the bulk density of the powder may be disregarded as long as a sintered body of 90% or more that can sufficiently withstand a later-described plastic working process can be obtained, it is preferable to use the Mo powder with a purity of 99.9 mass % or more and an Fsss (Fisher-Sub-Sieve Sizer) average particle size in a range of 2.5 to 6.0 μm. Herein, the purity is obtained by a molybdenum material analysis method described in JIS H 1404 and represents a metal purity exclusive of values of Al, Ca, Cr, Cu, Fe, Mg, Mn, Ni, Pn, Si, and Sn.

In the case where the $Mo_5SiB_2$ powder is used, the Fsss average particle size of the powder is preferably in a range of 0.05 to 5.0 μm.

Further, in the case where the $Mo_5SiB_2$ powder is used, the component ratio is not necessarily complete. For example, even if a compound containing at least two or more kinds of Mo, Si, and B, such as $Mo_3Si$, $Mo_5Si_3$, or $Mo_2B$, is present as later-described inevitable impurities, if $Mo_5SiB_2$ is a main component, the effect of this invention can be obtained.

Then, the raw material powders are mixed in a predetermined ratio to produce a mixed powder (S2 in FIG. 1).

An apparatus and method for use in mixing the powders are not particularly limited as long as a uniform mixed powder can be obtained. For example, a known mixer such as a ball mill, a shaker mixer, or a rocking mixer can be used as the apparatus while either a dry-type or a wet-type method can be used as the method.

In the mixing, a binder such as paraffin or polyvinyl alcohol may be added in an amount of 1 to 3 mass % to the powder mass for enhancing the moldability.

Then, the obtained mixed powder is compression-molded to form a compact (S3 in FIG. 1).

An apparatus for use in the compression molding is not particularly limited. A known molding machine such as a uniaxial pressing machine or a cold isostatic pressing machine (CIP, Cold Isostatic Pressing) may be used. With respect to the conditions of the compression, the conditions such as the pressing pressure and the press body density may be disregarded as long as a sintered body of 90% or more that can sufficiently withstand the plastic working process can be obtained.

Then, the obtained compact is sintered by heating (S4 in FIG. 1).

Specifically, a heat treatment may be carried out, for example, in an inert atmosphere such as hydrogen, vacuum, or Ar at 1600 to 1900° C. In this event, in the case where the binder is added, heating is carried out up to, for example, 800° C. in a hydrogen or vacuum atmosphere before the sintering, thereby removing the binder.

In the case of the sintering in the gas atmosphere, the in-furnace pressure may be disregarded as long as a sintered body of 90% or more that can sufficiently withstand the later-described plastic working process can be obtained.

Then, the obtained sintered body is subjected to plastic working, thereby being formed to a desired shape (S5 in FIG. 1).

Herein, as long as sufficient strength and ductility can be obtained over a wide temperature range, plastic working techniques such as plate rolling, bar rolling, forging, extrusion, swaging, hot compression (hot press), and sizing may be disregarded and further the temperature and the total reduction ratio in the plastic working and the conditions of heat treatment and so on after the plastic working may also be disregarded. However, it is preferable to carry out the plastic working at a total reduction ratio of 10% or more and 98% or less.

This is because if the total reduction ratio is less than 10%, a heat-resistant material excellent in strength and ductility cannot be obtained and, while it is possible to carry out the plastic working at a total reduction ratio of more than 98%, the productivity and cost are degraded correspondingly.

The working shape is, for example, a plate shape. However, even if the working shape is a shape other than the plate shape, for example, a wire or rod shape, if the composition is controlled, it is possible to obtain a material having high strength and high ductility over a wide temperature range.

Then, a coating film is formed on a surface of the alloy if necessary (S6 in FIG. 1). The coating film to be formed and its forming method are as described before.

The foregoing is the method of manufacturing the heat-resistant molybdenum alloy of the first embodiment of this invention.

As described above, the heat-resistant molybdenum alloy of the first embodiment of this invention comprises the first phase containing Mo as the main component and the second phase comprising the Mo—Si—B-based intermetallic compound particle phase, wherein the balance is the inevitable impurities and wherein the Si content is 0.05 mass % or more and 0.80 mass % or less and the B content is 0.04 mass % or more and 0.60 mass % or less.

Therefore, the heat-resistant molybdenum alloy of this invention has the strength equal to or greater than conventional and yet has the ductility over the wide temperature range.

Next, a second embodiment of this invention will be described.

The second embodiment is such that at least one kind of Ti, Y, Zr, Hf, V, Nb, Ta, and La is added to the first phase in the first embodiment.

In the second embodiment, description of portions common to the first embodiment will be appropriately omitted while portions which differ from the first embodiment will be mainly described.

<Heat-Resistant Molybdenum Alloy Composition>

First, the composition of a heat-resistant molybdenum alloy of the second embodiment of this invention will be described.

The heat-resistant molybdenum alloy of the second embodiment of this invention has, as in the first embodiment, a structure comprising a first phase containing Mo as a main component and a second phase comprising a Mo—Si—B-based intermetallic compound particle phase, wherein the second phase is dispersed in the first phase.

Hereinbelow, the respective phases and materials forming them will be described.

<First Phase>

In the second embodiment, the first phase has a structure in which at least one kind of elements among Ti, Y, Zr, Hf, V, Nb, Ta, and La is made into a solid solution with Mo, at least one kind of carbide particles, oxide particles, and boride particles of the elements is dispersed in Mo, or part of the element is made into a solid solution with Mo and the balance is dispersed as carbide particles, oxide particles, or boride particles in Mo.

With this structure, the high-temperature strength can be further enhanced.

In this case, if the total content of Ti, Y, Zr, Hf, V, Nb, Ta, and La is less than 0.1 mass %, the recrystallization temperature improving effect cannot be obtained. On the other hand, if it exceeds 5 mass %, not only the plastic workability but also the ductility is extremely reduced, and therefore, an obtained alloy departs from the spirit of this invention and cannot be said to be a material that can be used over a wide temperature range.

Therefore, the total content is preferably 0.1 mass % or more and 5 mass % or less.

In order to enhance the strength of the material and to prevent significant reduction in the ductility of the material, the total content of Ti, Y, Zr, Hf, V, Nb, Ta, and La in the alloy is more preferably 0.10 mass % or more and 3.5 mass % or less, further preferably 0.20 mass % or more and 2.5 mass % or less, and most preferably 0.30 mass % or more and 1.5 mass % or less.

In the case where solid solution formation of Ti, Y, Zr, Hf, V, Nb, Ta, and La and dispersion of carbide/oxide/boride occur compositely, the same effect can be obtained regardless of the solid solution-dispersed substance concentration ratio as long as the total content is in the range of this invention. Further, even in the case of a solid solution of different kinds of materials such as yttria-stabilized zirconia ($ZrO_2$—5 to 10 mass % $Y_2O_3$, so-called YSZ), the same effect can be obtained.

Further, if the particle diameter of a carbide, an oxide, or a boride in a carbide/oxide/boride particle alloy is less than 0.05 μm, the strength improving effect is small because it tends to be decomposed. On the other hand, if it exceeds 50 μm, the ductility is extremely reduced, which is thus not preferable. Further, this is not preferable because the density of a sintered body is difficult to increase.

Therefore, the particle diameter is preferably 0.05 μm or more and 50 μm or less.

In order to enhance the strength of the material and to prevent significant reduction in the ductility of the material, the average particle diameter of the carbide, the oxide, or the boride in the heat-resistant alloy is more preferably 0.05 μm or more and 20 μm or less and further preferably 0.05 μm or more and 5 μm or less.

Herein, the average particle diameter is an average value obtained by taking an enlarged photograph of magnifications capable of judging the size of the carbide, the oxide, or the boride and measuring the major axes of at least 50 arbitrary particles on the photograph.

The foregoing is the structure of the first phase.

<Second Phase>

The second phase is, as in the first embodiment, a phase comprising a Mo—Si—B-based intermetallic compound particle phase and, for example, $Mo_5SiB_2$ is cited as a Mo—Si—B-based intermetallic compound particle.

Since the composition ratio of Si and B and the structure are the same as those in the first embodiment, description thereof will be omitted.

<Manufacturing Method>

Next, a method of manufacturing the heat-resistant molybdenum alloy of the second embodiment of this invention will be briefly described.

While the method of manufacturing the heat-resistant molybdenum alloy of the second embodiment is the same as that of the first embodiment, different portions will be described.

First, with respect to raw materials, as long as the first phase and the second phase can be obtained in the range of this invention by the manufacturing method of this invention, starting raw material powders may be any combination of, for example, a pure metal (Mo, Si, B, Ti, Zr, Hf, V, Ta, Nb) and a compound ($Mo_5SiB_2$, MoB, $MoSi_2$, $TiH_2$, $ZrH_2$, TiC, ZrC, TiCN, ZrCN, NbC, VC, $TiO_2$, $ZrO_2$, YSZ, $La_2O_3$, $Y_2O_3$, TiB, or the like).

With respect to the $Mo_5SiB_2$ powder, it is preferable to use the powder having an Fsss (Fisher-Sub-Sieve Sizer) average particle size in a range of 0.5 to 5.0 μm.

In the case where $Mo_5SiB_2$ is used, the component ratio is not necessarily complete. For example, even if a compound containing at least two or more kinds of Mo, Si, and B, such as $Mo_3Si$, $Mo_5Si_3$, or $Mo_2B$, is present as later-described inevitable impurities, if $Mo_5SiB_2$ is a main component, the effect of this invention can be obtained.

As long as a sintered body of 90% or more that can sufficiently withstand a later-described plastic working process can be obtained with a particle diameter of a solid solution, a carbide, an oxide, or a boride defined in this invention, the powder properties such as the particle diameter and the bulk density of the raw material powders may be disregarded. However, with respect to the Mo powder, it is preferable to use the powder with a purity of 99.9 mass % or more and an Fsss average particle size in a range of 2.5 to 6.0 μm. Herein, the purity of the Mo powder is obtained by a molybdenum material analysis method described in JIS H 1404 and represents a metal purity exclusive of values of Al, Ca, Cr, Cu, Fe, Mg, Mn, Ni, Pn, Si, and Sn. Further, the Fsss average particle size of a metal or a compound as a source of Ti, Y, Zr, Hf, V, Ta, Nb, or La is preferably in a range of 1.0 to 50.0 μm.

As an element, other than the foregoing, to be added to Mo, the same effect can be obtained using a metal (Re, W, Cr, or the like) which is made into a solid solution with Mo, a compound (rare earth oxide, rare earth boride) which is stable in Mo, or the like.

A particle of Ti, Y, Zr, Hf, V, Ta, Nb, La, or the like present in the alloy is not necessarily a perfect carbide, oxide, or boride. For example, the same effect can be obtained even if a carbide particle is partially oxidized or a boride particle is partially oxidized.

Further, in order to prevent oxidation of an added element in sintering or to carbonize an added element in sintering, carbon or a material (e.g. graphite powder, $Mo_2C$) as a carbon supply source can be added in an arbitrary amount. In this case, carbon with a Mo crystal grain diameter may segregate after the sintering, but, carbon is known as an element capable of strengthening the grain boundaries of molybdenum and thus does not degrade the material properties.

After this, a mixed powder is prepared, molded, sintered, and subjected to plastic working to thereby manufacture a heat-resistant alloy and then, if necessary, a coating film is formed on a surface of the alloy. Since these specific methods and conditions are the same as those in the first embodiment, description thereof will be omitted.

As described above, the heat-resistant molybdenum alloy of the second embodiment of this invention comprises the first phase containing Mo as the main component and the second phase comprising the Mo—Si—B-based intermetallic compound particle phase, wherein the Si content is 0.05 mass % or more and 0.80 mass % or less and the B content is 0.04 mass % or more and 0.60 mass % or less.

Therefore, the same effect as in the first embodiment can be achieved.

Further, according to the second embodiment, the first phase has the structure in which at least one kind of Ti, Y, Zr, Hf, V, Ta, Nb and La is made into a solid solution with Mo, at least one kind of carbide particles, oxide particles, and boride particles of the elements is dispersed in Mo, or part of the element is made into a solid solution with Mo and the balance is dispersed as carbide particles, oxide particles, or boride particles in Mo.

Therefore, the high-temperature strength can be further enhanced compared to the first embodiment.

EXAMPLES

Hereinbelow, this invention will be described in further detail with reference to Examples.

Example 1

Heat-resistant molybdenum alloys according to the first embodiment were manufactured and the mechanical properties thereof were evaluated. Specific sequences were as follows.

<Manufacture of Samples>

First, a pure Mo powder with an average particle diameter of 4.3 μm and a $Mo_5SiB_2$ powder with an average particle diameter of 3.2 μm as measured by the Fsss method were weighed to satisfy respective nominal compositions and then were dry-mixed together for 2 hours using a shaker mixer, thereby obtaining mixed powders.

Then, the obtained mixed powders were press-molded at 2 ton/cm$^2$ by cold isostatic pressing, thereby obtaining mixed powder compacts.

While there are various molding methods such as uniaxial pressing and isostatic pressing, the molding method is not limited since it is possible to obtain a molybdenum alloy having a density of 90% or more with respect to the theoretical density after sintering.

Then, the mixed powder compacts were sintered in a hydrogen atmosphere at 1850° C. for 15 hours, thereby obtaining sintered bodies each having a width of 110 mm, a length of 50 mm, and a thickness of 15 mm as materials to be subjected to plastic working. The sintered bodies as the products of this invention each had a relative density of 93% or more.

Then, the sintered bodies were subjected to plastic working. Specifically, each sintered body was heated to 1200° C. and then rolled to a plate shape using a rolling mill. While the roll-to-roll distance, i.e. the rolling reduction ratio (=((thickness before rolling)−(thickness after rolling))×100/(thickness before rolling) unit %), per pass was set to less than 20% (not including 0), the sintered body was rolled to a plate thickness of 1.5 mm corresponding to a total reduction ratio of 90%. The rolling reduction ratio per pass was set to less than 20% in this Example, but, even if it is set to 20% or more, unless cracks occur to extremely reduce the yield, no problem arises. The products of this invention had almost no cracks in the rolling and the yield was high. The products of this invention (samples whose Si—B compositions fall in the range) are samples identified by sample numbers 1 to 15 while comparative examples (samples whose Si—B compositions fall outside the range) are samples identified by sample numbers 16 to 19.

The average particle diameters of Mo—Si—B alloy particles dispersed in the heat-resistant materials of the products of this invention were 2.8 to 3.2 μm.

Further, as other comparative examples, samples with sample numbers 20 and 21 corresponding to Mo—Si—B-based alloys of Patent Document 1 and samples with sample numbers 22 and 23 corresponding to Mo—Si—B-based alloys of Patent Document 2 were also manufactured. However, since these samples were very poor in plastic workability, cracks easily occurred and thus the yield was low. Further, pure Mo identified by sample number 24 was also prepared as another comparative example.

<Mechanical Property Evaluation by Tensile Test (Room Temperature)>From each of the obtained samples, a tensile test piece with a parallel portion having a length of 8 mm, a width of 3 mm, and a thickness of 1.0 mm was cut out. Then, the surface of the tensile test piece was polished with #600 SiC polishing paper and then subjected to electrolytic polishing. Then, the tensile test piece was set in an Instron universal tester (model 5867), where a tensile test was conducted at a crosshead speed of 0.32 mm/min at room temperature (20° C.) in the atmosphere. The yield stress, the maximum stress, and the breaking elongation were obtained from a stress-strain diagram obtained by the tensile test. The obtained results are shown in Table 1.

TABLE 1

| Sample No. | | composition (mass %) | $Mo_5SiB_2$ addition amount (mass %) | test temperature (° C.) | yield stress (MPa) | maximum stress (MPa) | breaking elongation (%) |
|---|---|---|---|---|---|---|---|
| 1 | this invention | Mo-0.05Si-0.04B | 1 | 20 | 997 | 1082 | 35 |
| 2 | | Mo-0.1Si-0.08B | 2 | | 1034 | 1120 | 32 |
| 3 | | Mo-0.15Si-0.12B | 3 | | 1102 | 1186 | 31 |
| 4 | | Mo-0.21Si-0.16B | 4 | | 1160 | 1240 | 28 |
| 5 | | Mo-0.26Si-0.20B | 5 | | 1220 | 1280 | 25 |
| 6 | | Mo-0.32Si-0.25B | 6 | | 1269 | 1347 | 25 |
| 7 | | Mo-0.37Si-0.29B | 7 | | 1288 | 1382 | 23 |
| 8 | | Mo-0.42Si-0.33B | 8 | | 1302 | 1398 | 20 |
| 9 | | Mo-0.48Si-0.37B | 9 | | 1330 | 1402 | 18 |
| 10 | | Mo-0.53Si-0.41B | 10 | | 1319 | 1413 | 17 |
| 11 | | Mo-0.58Si-0.45B | 11 | | 1334 | 1430 | 15 |
| 12 | | Mo-0.64Si-0.49B | 12 | | 1382 | 1452 | 13 |
| 13 | | Mo-0.69Si-0.53B | 13 | | 1392 | 1463 | 10 |
| 14 | | Mo-0.74Si-0.57B | 14 | | 1390 | 1465 | 11 |
| 15 | | Mo-0.80Si-0.60B | 15 | | 1401 | 1472 | 10 |
| 16 | comparative example | Mo-0.04Si-0.04B | (Si less than lower limit) (B lower limit) | | 850 | 920 | 37 |
| 17 | | Mo-0.05Si-0.03B | (Si less than lower limit) (B lower limit) | | 840 | 931 | 35 |
| 18 | | Mo-0.81Si-0.60B | (Si more than upper limit) (B upper limit) | | 1382 | 1468 | 6 |
| 19 | | Mo-0.80Si-0.61B | (Si more than upper limit) (B upper limit) | | 1398 | 1459 | 5 |
| 20 | | Mo-1.0Si-0.5B | (composition lower limit of Patent Document 1) | | — | 1520 | 0 |
| 21 | | Mo-4.5Si-4.0B | (composition upper limit of Patent Document 1) | | — | 1640 | 0 |
| 22 | | Mo-2.0Si-1.4B | (composition lower limit of Patent Document 2) | | — | 1530 | 0 |

TABLE 1-continued

| Sample No. | composition (mass %) | $Mo_5SiB_2$ addition amount (mass %) | test temperature (° C.) | yield stress (MPa) | maximum stress (MPa) | breaking elongation (%) |
|---|---|---|---|---|---|---|
| 23 | Mo-3.9Si-3.5B | (composition upper limit of Patent Document 2) | | — | 1620 | 0 |
| 24 | Mo | — | | 840 | 900 | 38 |

As shown in Table 1, the products of this invention showed high strength and ductility while, in the case of sample numbers 20 to 23 (materials of Patent Documents 1 and 2), the strength was high but the ductility was 0.

With respect to sample number 16 (Si content was less than 0.05 mass %) and sample number 17 (B content was less than 0.04 mass %), while the ductility was as high as that of pure Mo, the strength was extremely low compared to the products of this invention and was as low as that of pure Mo. It has been seen that if the Si or B content is less than the range of this application even slightly, the strength is largely reduced so that the Si—B adding effect cannot be obtained.

Further, with respect to sample number 18 (Si content was higher than 0.80 mass %) and sample number 19 (B content was higher than 0.60 mass %), while the strength was high, the ductility was extremely low compared to the products of this invention. It has been seen that if the Si or B content exceeds the range of this application even slightly, the ductility is largely reduced.

<Mechanical Property Evaluation by Tensile Test (High Temperature)>

From each of the materials subjected to the plastic working, a tensile test piece with a parallel portion having a length of 8 mm, a width of 3 mm, and a thickness of 1.0 mm was cut out. Then, the surface of the tensile test piece was polished with #600 SiC polishing paper and then subjected to electrolytic polishing. Then, the tensile test piece was set in an Instron universal tester (model 5867), where a tensile test was conducted at a crosshead speed of 0.32 mm/min at 800° C. in an argon atmosphere. The yield stress, the maximum stress, and the breaking elongation were obtained from a stress-strain diagram obtained by the tensile test. The obtained results are shown in Table 2.

| Sample No. | | composition (mass %) | $Mo_5SiB_2$ addition amount (mass %) | test temperature (° C.) | yield stress (MPa) | maximum stress (MPa) | breaking elongation (%) |
|---|---|---|---|---|---|---|---|
| 1 | this invention | Mo-0.05Si-0.04B | 1 | 800 | 644 | 812 | 32 |
| 2 | | Mo-0.1Si-0.08B | 2 | | 699 | 824 | 30 |
| 3 | | Mo-0.15Si-0.12B | 3 | | 766 | 898 | 27 |
| 4 | | Mo-0.21Si-0.16B | 4 | | 932 | 1064 | 25 |
| 5 | | Mo-0.26Si-0.20B | 5 | | 940 | 1100 | 25 |
| 6 | | Mo-0.32Si-0.25B | 6 | | 1009 | 1149 | 26 |
| 7 | | Mo-0.37Si-0.29B | 7 | | 1078 | 1190 | 22 |
| 8 | | Mo-0.42Si-0.33B | 8 | | 1149 | 1232 | 22 |
| 9 | | Mo-0.48Si-0.37B | 9 | | 1132 | 1239 | 20 |
| 10 | | Mo-0.53Si-0.41B | 10 | | 1163 | 1245 | 19 |
| 11 | | Mo-0.58Si-0.45B | 11 | | 1159 | 1262 | 15 |
| 12 | | Mo-0.64Si-0.49B | 12 | | 1192 | 1289 | 13 |
| 13 | | Mo-0.69Si-0.53B | 13 | | 1199 | 1301 | 10 |
| 14 | | Mo-0.74Si-0.57B | 14 | | 1200 | 1322 | 11 |
| 15 | | Mo-0.80Si-0.60B | 15 | | 1223 | 1333 | 11 |
| 16 | comparative example | Mo-0.04Si-0.04B | (Si less than lower limit) (B lower limit) | | 453 | 590 | 33 |
| 17 | | Mo-0.05Si-0.03B | (Si less than lower limit) (B lower limit) | | 462 | 588 | 31 |
| 18 | | Mo-0.81Si-0.60B | (Si more than upper limit) (B upper limit) | | 1263 | 1363 | 5 |
| 19 | | Mo-0.80Si-0.61B | (Si more than upper limit) (B upper limit) | | 1258 | 1372 | 6 |
| 20 | | Mo-1.0Si-0.5B | (composition lower limit of Patent Document 1) | | 1389 | 1442 | 2 |
| 21 | | Mo-4.5Si-4.0B | (composition upper limit of Patent Document 1) | | 1492 | 1580 | 0.1 |
| 22 | | Mo-2.0Si-1.4B | (composition lower limit of Patent Document 2) | | 1432 | 1483 | 1 |

-continued

| Sample No. | composition (mass %) | $Mo_5SiB_2$ addition amount (mass %) | test temperature (° C.) | yield stress (MPa) | maximum stress (MPa) | breaking elongation (%) |
|---|---|---|---|---|---|---|
| 23 | Mo-3.9Si-3.5B | (composition upper limit of Patent Document 2) | | 1502 | 1562 | 0.3 |
| 24 | Mo | — | | 403 | 512 | 32 |

As shown in Table 2, the products of this invention showed high strength and ductility while, in the case of sample numbers 20 to 23 (materials of Patent Documents 1 and 2), the strength was high but the ductility was close to 0.

With respect to sample number 16 (Si content was less than 0.05 mass %) and sample number 17 (B content was less than 0.04 mass %), while the ductility was as high as that of pure Mo, the strength was extremely low compared to the products of this invention and was as low as that of pure Mo. It has been seen that if the Si or B content is less than the range of this application even slightly, the strength is largely reduced so that the Si—B adding effect cannot be obtained.

Further, with respect to sample number 18 (Si content was higher than 0.80 mass %) and sample number 19 (B content was higher than 0.60 mass %), while the strength was high, the ductility was extremely low compared to the products of this invention. It has been seen that if the Si or B content exceeds the range of this application even slightly, the ductility is largely reduced.

From the results described above, it has been seen that the products of this invention can satisfy both the strength and ductility over the wide temperature range. Conversely, it has been seen that if the Si—B composition deviates from the composition range of this invention even slightly, it is not possible to satisfy both the strength and ductility.

<Effect of $Mo_5SiB_2$ Particle Diameter>

With respect to sample number 5 of this invention, using $Mo_5SiB_2$ powders prepared by pulverization and classification, there were prepared plate members which respectively had average particle diameters, of Mo—Si—B-based intermetallic compound particles in heat-resistant alloys, of 0.05 μm, 0.5 μm, 1.0 μm, 3.2 μm, 12.2 μm, 20.0 μm, and 20.9 μm and each of which was adjusted to a plate thickness of 1.5 mm at a total reduction ratio of 90%. From each of these materials subjected to the plastic working, a tensile test piece with a parallel portion having a length of 8 mm, a width of 3 mm, and a thickness of 1.0 mm was cut out. Then, the surface of the tensile test piece was polished with #600 SiC polishing paper and then subjected to electrolytic polishing. Then, the tensile test piece was set in an Instron universal tester (model 5867), where a tensile test was conducted at a crosshead speed of 0.32 mm/min at room temperature (20° C.) in the atmosphere. The yield stress, the maximum stress, and the breaking elongation were obtained from a stress-strain diagram obtained by the tensile test. The obtained results are shown in Table 3.

TABLE 3

| | composition (mass %) | $Mo_5SiB_2$ average particle diameter (μm) | test temperature (° C.) | yield stress (MPa) | maximum stress (MPa) | breaking elongation (%) |
|---|---|---|---|---|---|---|
| this invention | Mo-0.26Si-0.20B | 0.05 | 20 | 1240 | 1340 | 25 |
| | | 0.5 | | 1224 | 1312 | 24 |
| | | 1 | | 1232 | 1290 | 24 |
| | | 3.2 | | 1220 | 1280 | 25 |
| | | 10 | | 1192 | 1260 | 14 |
| | | 20 | | 1123 | 1258 | 10 |
| comparative example | | 20.9 | | 1145 | 1240 | 4 |

As shown in Table 3, when the average particle diameter exceeded 20 μm, the strength was high but the ductility was extremely low.

<Effect of Total Reduction Ratio and Aspect Ratio>

With respect to sample number 5 of this invention using $Mo_5SiB_2$ with the average particle diameter of 3.2 μm, there were prepared plate members with different total reduction ratios of 9 to 99% in rolling.

Aspect ratios of Mo metal phases of the obtained plate members were calculated to be 1.4 to 1000.

Then, from each of the obtained plate members, a tensile test piece with a plate thickness of 1.5 mm and with a parallel portion having a length of 8 mm, a width of 3 mm, and a thickness of 1.0 mm was cut out. Then, the surface of the tensile test piece was polished with #600 SiC polishing paper and then subjected to electrolytic polishing. Then, the tensile test piece was set in an Instron universal tester (model 5867), where a tensile test was conducted at a crosshead speed of 0.32 mm/min at room temperature (20° C.) in the atmosphere. The yield stress, the maximum stress, and the breaking elongation were obtained from a stress-strain diagram obtained by the tensile test. The obtained results are shown in Table 4.

TABLE 4

| | composition (mass %) | total reduction ratio (%) | aspect ratio of Mo metal phase | test temperature (° C.) | yield stress (MPa) | maximum stress (MPa) | breaking elongation (%) |
|---|---|---|---|---|---|---|---|
| this invention | Mo-0.26Si-0.20B | 10 | 1.5 | 20 | 880 | 1000 | 38 |
| | | 30 | 20 | | 920 | 1050 | 36 |
| | | 40 | 50 | | 980 | 1080 | 30 |
| | | 60 | 150 | | 1040 | 1130 | 27 |
| | | 90 | 300 | | 1220 | 1280 | 25 |
| | | 96 | 500 | | 1230 | 1310 | 18 |
| | | 98 | 1000 | | 1250 | 1330 | 10 |
| | | 9 | 1.4 | | 350 | 440 | 38 |
| | | 99 | 1012 | | 1260 | 1340 | 8 |
| comparative example | Mo | 10 | 1.5 | | 280 | 400 | 40 |

As shown in Table 4, when the total reduction ratio was less than 10% so that the aspect ratio of the Mo metal phase was less than 1.5, the strength was low while when the total reduction ratio exceeded 98% so that the aspect ratio of the Mo metal phase exceeded 1000, the ductility was reduced.

<Evaluation of Oxide Coating Layer>

With respect to each of the obtained samples, a coating film was formed and evaluated under the same conditions as those in a technique described in JP-A-2004-281392.

As a result, the product yield was good if the products were in the range of this invention, and the mold releasability and the stability, warping, and durability of the coating layers were the same as those in the prior art.

Example 2

Heat-resistant molybdenum alloys according to the second embodiment were manufactured and the mechanical properties thereof were evaluated. Specific sequences were as follows.

<Manufacture of Samples>

First, a pure Mo powder with an average particle diameter of 4.3 μm and a $Mo_5SiB_2$ powder with an average particle diameter of 3.2 μm as measured by the Fsss method and metal elements or compounds as sources of Ti, Y, Zr, Hf, V, Ta, NB, and La were weighed to satisfy respective nominal compositions and then were dry-mixed together for 2 hours using a shaker mixer, thereby obtaining mixed powders.

Herein, the materials were prepared by fixedly setting the addition amount of $Mo_5SiB_2$ to 5 mass %.

Then, the obtained mixed powders were press-molded at 2 ton/cm$^2$ by cold isostatic pressing, thereby obtaining mixed powder compacts.

Then, the mixed powder compacts were sintered in a hydrogen atmosphere at 1850° C. for 15 hours, thereby obtaining sintered bodies each having a width of 110 mm, a length of 50 mm, and a thickness of 15 mm as materials to be subjected to plastic working. The sintered bodies as the products of this invention each had a relative density of 93% or more.

Then, the sintered bodies were subjected to plastic working. Specifically, each sintered body was heated to 1200° C. and then rolled to a plate shape using a rolling mill. While the roll-to-roll distance, i.e. the rolling reduction ratio (=((thickness before rolling)−(thickness after rolling))×100/(thickness before rolling) unit %), per pass was set to less than 20% (not including 0), the sintered body was rolled to a plate thickness of 1.5 mm corresponding to a total reduction ratio of 90%. The products of this invention had almost no cracks in the rolling and the yield was high. Herein, sample numbers of the materials whose compositions of Ti, Y, Zr, Hf, V, Ta, Nb, and La were in the range of this invention were set to 1 to 20 while sample numbers of the materials outside the range of this invention were set to 21 to 24.

The average particle diameters of Mo—Si—B-based intermetallic compound particles dispersed in the heat-resistant materials of the products of this invention were 2.6 to 3.1 μm.

<Mechanical Property Evaluation by Tensile Test (Room Temperature)>

From each of the materials subjected to the plastic working, a tensile test piece with a parallel portion having a length of 8 mm, a width of 3 mm, and a thickness of 1.0 mm was cut out. Then, the surface of the tensile test piece was polished with #600 SiC polishing paper and then subjected to electrolytic polishing. Then, the tensile test piece was set in an Instron universal tester (model 5867), where a tensile test was conducted at a crosshead speed of 0.32 mm/min at room temperature (20° C.) in the atmosphere. The yield stress, the maximum stress, and the breaking elongation were obtained from a stress-strain diagram obtained by the tensile test. The obtained results are shown in Table 5.

As shown in Table 5, the strength was slightly improved due to solid-solution strengthening and dispersion strengthening achieved by adding Ti, Y, Zr, Hf, V, Ta, Nb, or La, but the improvement in strength was not so large as that obtained by adding the Mo—Si—B-based intermetallic compound.

TABLE 5

| Sample No. | | composition (mass %) | remarks | test temperature (° C.) | yield stress (MPa) | maximum stress (MPa) | breaking elongation (%) |
|---|---|---|---|---|---|---|---|
| 1 | this invention | Mo-5$Mo_5SiB_2$-0.1Ti | base material | 20 | 1220 | 1280 | 25 |
| 2 | | Mo-5$Mo_5SiB_2$-0.1Ti | | | 1225 | 1300 | 24 |

TABLE 5-continued

| Sample No. | | composition (mass %) | remarks | test temperature (° C.) | yield stress (MPa) | maximum stress (MPa) | breaking elongation (%) |
|---|---|---|---|---|---|---|---|
| 3 | | Mo-5$Mo_5SiB_2$-0.2Zr-C | Zr partially carbonized | | 1220 | 1295 | 26 |
| 4 | | Mo-5$Mo_5SiB_2$-0.2Ta-0.1$ZrO_2$ | | | 1230 | 1300 | 27 |
| 5 | | Mo-5$Mo_5SiB_2$-0.5Ti-0.1Zr-C | Ti and Zr partially carbonized | | 1220 | 1280 | 25 |
| 6 | | Mo-5$Mo_5SiB_2$-0.5$NbB_2$-0.3NbC | | | 1225 | 1310 | 23 |
| 7 | | Mo-5$Mo_5SiB_2$-1.0Ti-C | Ti partially carbonized | | 1250 | 1320 | 24 |
| 8 | | Mo-5$Mo_5SiB_2$-1.0HfC | | | 1250 | 1310 | 22 |
| 9 | | Mo-5$Mo_5SiB_2$-1.0YSZ | | | 1240 | 1300 | 24 |
| 10 | | Mo-5$Mo_5SiB_2$-1.0$La_2O_3$ | | | 1235 | 1290 | 25 |
| 11 | | Mo-5$Mo_5SiB_2$-1.0$Y_2O_3$ | | | 1240 | 1310 | 24 |
| 12 | | Mo-5$Mo_5SiB_2$-1.0Ti-0.5VC | | | 1260 | 1315 | 23 |
| 13 | | Mo-5$Mo_5SiB_2$-1.0Ti-0.5$TiO_2$ | | | 1255 | 1300 | 21 |
| 14 | | Mo-5$Mo_5SiB_2$-2.0Ti-C | Ti partially carbonized | | 1255 | 1330 | 20 |
| 15 | | Mo-5$Mo_5SiB_2$-1.0Ti-1.0Zr-C | Ti and Zr partially carbonized | | 1240 | 1340 | 20 |
| 16 | | Mo-5$Mo_5SiB_2$-2.0Ti-1.0HfC | | | 1250 | 1350 | 13 |
| 17 | | Mo-5$Mo_5SiB_2$-3.0Ta-C | Ta partially carbonized | | 1240 | 1340 | 15 |
| 18 | | Mo-5$Mo_5SiB_2$-2.0Ti-2.0Zr-C | Ti and Zr partially carbonized | | 1260 | 1360 | 14 |
| 19 | | Mo-5$Mo_5SiB_2$-4.0$TiO_2$ | | | 1250 | 1380 | 13 |
| 20 | | Mo-5$Mo_5SiB_2$-2.0Ti-3.0$TiB_2$-C | Ti partially carbonized | | 1280 | 1400 | 12 |
| 21 | reference material | Mo-5$Mo_5SiB_2$-0.09Ti | added element less than lower limit | | 1210 | 1270 | 24 |
| 22 | | Mo-5$Mo_5SiB_2$-0.05Ti-0.02$TiO_2$ | added element less than lower limit | | 1200 | 1260 | 20 |
| 23 | | Mo-5$Mo_5SiB_2$-5.1Zr-C | added element more than upper limit, Zr partially carbonized | | 1290 | 1400 | 8 |
| 24 | | Mo-5$Mo_5SiB_2$-3.0TiC-3.0Zr-C | added element more than upper limit, Zr partially carbonized | | 1280 | 1420 | 4 |

<Mechanical Property Evaluation by Tensile Test (High Temperature)>

From each of the materials subjected to the plastic working, a tensile test piece with a parallel portion having a length of 8 mm, a width of 3 mm, and a thickness of 1.0 mm was cut out. Then, the surface of the tensile test piece was polished with #600 SiC polishing paper and then subjected to electrolytic polishing. Then, the tensile test piece was set in an Instron universal tester (model 5867), where a tensile test was conducted at a crosshead speed of 0.32 mm/min at 1000° C. in an argon atmosphere. The yield stress, the maximum stress, and the breaking elongation were obtained from a stress-strain diagram obtained by the tensile test. The obtained results are shown in Table 6.

The strength of a Mo alloy (sample number 1) added only with the Mo—Si—B-based intermetallic compound, i.e. not added with the source of Ti, Y, Zr, Hf, V, Ta, Nb, or La, was reduced to less than a half of that at room temperature while the materials of sample numbers 2 to 17 in which Ti, Zr, Hf, V, or Ta was made into a solid solution or dispersed as a carbide, an oxide, or a boride maintained high strength. The comparative materials were reduced in strength like sample number 1 or had high strength but almost no ductility.

From the results described above, it has been seen that the high-temperature strength is improved by adding the source of Ti, Y, Zr, Hf, V, Ta, NB, or La compared to the case where such a source is not added. On the other hand, as described above, the room-temperature strength is not significantly improved by adding the above-mentioned element. Accordingly, it has been seen that whether or not to add the element may be determined depending on the temperature of use.

TABLE 6

| Sample No. | | composition (mass %) | remarks | test temperature (° C.) | yield stress (MPa) | maximum stress (MPa) | breaking elongation (%) |
|---|---|---|---|---|---|---|---|
| 1 | this invention | Mo-5$Mo_5SiB_2$-0.1Ti | | 1000 | 460 | 500 | 40 |
| 2 | | Mo-5$Mo_5SiB_2$-0.1Ti | | | 780 | 840 | 30 |
| 3 | | Mo-5$Mo_5SiB_2$-0.2Zr-C | Zr partially carbonized | | 820 | 880 | 28 |
| 4 | | Mo-5$Mo_5SiB_2$-0.2Ta-0.1$ZrO_2$ | | | 860 | 940 | 27 |
| 5 | | Mo-5$Mo_5SiB_2$-0.5Ti-0.1Zr-C | Ti and Zr partially carbonized | | 920 | 1000 | 25 |
| 6 | | Mo-5$Mo_5SiB_2$-0.5$NbB_2$-0.3NbC | | | 930 | 1050 | 25 |
| 7 | | Mo-5$Mo_5SiB_2$-1.0Ti-C | Ti partially carbonized | | 925 | 1025 | 27 |
| 8 | | Mo-5$Mo_5SiB_2$-1.0HfC | | | 910 | 1030 | 22 |
| 9 | | Mo-5$Mo_5SiB_2$-1.0YSZ | | | 915 | 1022 | 20 |
| 10 | | Mo-5$Mo_5SiB_2$-1.0$La_2O_3$ | | | 920 | 1025 | 21 |
| 11 | | Mo-5$Mo_5SiB_2$-1.0$Y_2O_3$ | | | 910 | 1000 | 22 |
| 12 | | Mo-5$Mo_5SiB_2$-1.0Ti-0.5VC | | | 920 | 1020 | 25 |
| 13 | | Mo-5$Mo_5SiB_2$-1.0Ti-0.5$TiO_2$ | | | 930 | 1080 | 24 |
| 14 | | Mo-5$Mo_5SiB_2$-2.0Ti-C | Ti partially carbonized | | 940 | 1100 | 20 |
| 15 | | Mo-5$Mo_5SiB_2$-1.0Ti-1.0Zr-C | Ti and Zr partially carbonized | | 945 | 1090 | 21 |
| 16 | | Mo-5$Mo_5SiB_2$-2.0Ti-1.0HfC | | | 950 | 1100 | 20 |
| 17 | | Mo-5$Mo_5SiB_2$-3.0Ta-C | Ta partially carbonized | | 940 | 1105 | 18 |
| 18 | | Mo-5$Mo_5SiB_2$-2.0Ti-2.0Zr-C | Ti and Zr partially carbonized | | 960 | 1120 | 16 |
| 19 | | Mo-5$Mo_5SiB_2$-4.0$TiO_2$ | | | 960 | 1130 | 15 |
| 20 | | Mo-5$Mo_5SiB_2$-2.0Ti-3.0$TiB_2$-C | Ti partially carbonized | | 955 | 1140 | 14 |
| 21 | reference material | Mo-5$Mo_5SiB_2$-0.09Ti | added element less than lower limit | | 455 | 505 | 38 |
| 22 | | Mo-5$Mo_5SiB_2$-0.05Ti-0.02$TiO_2$ | added element less than lower limit | | 480 | 540 | 36 |
| 23 | | Mo-5$Mo_5SiB_2$-5.1Zr-C | added element more than upper limit, Zr partially carbonized | | 940 | 1100 | 6 |
| 24 | | Mo-5$Mo_5SiB_2$-3.0TiC-3.0Zr-C | added element more than upper limit, Zr partially carbonized | | 930 | 1095 | 3 |

<Effect of HfC Particle Diameter>

With respect to sample number 8 of this invention shown in Tables 5 and 6, using HfC powders prepared by pulverization and classification, there were prepared plate members which respectively had average particle diameters, of HfC in heat-resistant alloys, of 0.05 μm, 0.5 μm, 1.3 μm, 5.0 μm, 9.8 μm, 20.8 μm, 49.6 μm, and 51.0 μm and each of which was adjusted to a plate thickness of 1.5 mm at a total reduction ratio of 90%. From each of these materials subjected to the plastic working, a tensile test piece with a parallel portion having a length of 8 mm, a width of 3 mm, and a thickness of 1.0 mm was cut out. Then, the surface of the tensile test piece was polished with #600 SiC polishing paper and then subjected to electrolytic polishing. Then, the tensile test piece was set in an Instron universal tester (model 5867), where a tensile test was conducted at a crosshead speed of 0.32 mm/min at 1000° C. in an argon atmosphere. The yield stress, the maximum stress, and the breaking elongation were obtained from a stress-strain diagram obtained by the tensile test. The obtained results are shown in Table 7.

When the average particle diameter exceeded 50 μm, the strength was high but the ductility was extremely low.

TABLE 7

| | composition (mass %) | HfC average particle diameter (μm) | test temperature (° C.) | yield stress (MPa) | maximum stress (MPa) | breaking elongation (%) |
|---|---|---|---|---|---|---|
| this invention | Mo-5$Mo_5SiB_2$-1.0HfC | 0.05 | 1000 | 950 | 1100 | 25 |
| | | 0.5 | | 920 | 1040 | 24 |
| | | 1.3 | | 910 | 1030 | 22 |
| | | 5.0 | | 900 | 1000 | 25 |
| | | 9.8 | | 890 | 990 | 14 |
| | | 20.8 | | 860 | 980 | 13 |
| | | 49.6 | | 820 | 950 | 12 |
| reference material | | 51.0 | | 780 | 880 | 4 |

<Effect of Total Reduction Ratio and Aspect Ratio>

With respect to sample number 5 of this invention shown in Tables 5 and 6, there were prepared plate members with different total reduction ratios of 9 to 99% in rolling.

Aspect ratios of Mo metal phases of the obtained plate members were calculated to be 1.4 to 1000.

Then, from each of the obtained plate members, a tensile test piece with a plate thickness of 1.5 mm and with a parallel portion having a length of 8 mm, a width of 3 mm, and a thickness of 1.0 mm was cut out. Then, the surface of the tensile test piece was polished with #600 SiC polishing paper and then subjected to electrolytic polishing. Then, the tensile test piece was set in an Instron universal tester (model 5867), where a tensile test was conducted at a crosshead speed of 0.32 mm/min at 1000° C. in an argon atmosphere. The yield stress, the maximum stress, and the breaking elongation were obtained from a stress-strain diagram obtained by the tensile test. The obtained results are shown in Table 8.

TABLE 8

| | composition (mass %) | total reduction ratio (%) | aspect ratio of Mo metal phase | test temperature (° C.) | yield stress (MPa) | maximum stress (MPa) | breaking elongation (%) |
|---|---|---|---|---|---|---|---|
| this invention | Mo-5$Mo_5SiB_2$-0.5Ti-0.1Zr-C | 10 | 1.5 | 1000 | 560 | 630 | 38 |
| | | 30 | 20 | | 600 | 720 | 36 |
| | | 40 | 50 | | 910 | 960 | 31 |
| | | 60 | 150 | | 920 | 990 | 28 |
| | | 90 | 300 | | 920 | 1000 | 25 |
| | | 96 | 500 | | 980 | 1100 | 18 |
| | | 98 | 1000 | | 1100 | 1300 | 10 |
| reference material | | 9 | 1.4 | | 350 | 450 | 38 |
| | | 99 | 1012 | | 1200 | 1350 | 8 |

As shown in Table 8, as in Example 1, when the total reduction ratio was less than 10% so that the aspect ratio of the Mo metal phase was less than 1.5, the strength was low while when the total reduction ratio exceeded 98% so that the aspect ratio of the Mo metal phase exceeded 1000, the ductility was reduced.

<Evaluation of Oxide Coating Layer>

With respect to each of the obtained samples, a coating film was formed and evaluated under the same conditions as those in a technique described in JP-A-2004-281392.

As a result, the product yield was good if the products were in the range of this invention and, as in Example 1, the mold releasability and the stability, warping, and durability of the coating layers were the same as those in the prior art.

INDUSTRIAL APPLICABILITY

While this invention has been described with reference to the embodiments and the Examples, this invention is not limited thereto.

It is apparent that those who skilled in the art can think of various modifications and improvements in the scope of this invention and it is understood that those also belong to the scope of this invention.

This invention is applicable to heat-resistant members for use in a high-temperature environment, such as not only a high-temperature industrial furnace member, a hot extrusion die, and a firing floor plate, but also a friction stir welding tool, a glass melting tool, a seamless tube manufacturing piercer plug, an injection molding hot runner nozzle, a hot forging die, a resistance heating vapor deposition container, an aircraft jet engine, and a rocket engine.

The invention claimed is:

1. A molybdenum alloy end product comprising;

a first phase containing Mo as a main component; and a second phase which comprises 1 to 9 mass % of $Mo_5SiB_2$, in the molybdenum alloy end product as a Mo—Si—B—based intermetallic compound particle phase, wherein the molybdenum alloy end product comprises Si between 0.05 mass % and 0.48 mass % and B between 0.04 mass % and 0.37 mass %; and wherein a crystal grain of the first phase has an aspect ratio which is representative of a ratio of a major axis and a minor axis of the crystal grain and which is 1.5 or more and 300 or less.

2. The molybdenum alloy end product according to claim 1, being one of a high-temperature industrial furnace member, a hot extrusion die, a firing floor plate, a piercer plug, a hot forging die, and a friction stir welding tool.

3. A coated member comprising a molybdenum alloy end product having a surface and a coating film coated on the surface of the molybdenum alloy end product; wherein:

the molybdenum alloy end product comprises:

a first phase containing Mo as a main component; and a second phase which comprises 1 to 9 mass % of $Mo_5SiB_2$ , in the molybdenum alloy end product as a Mo—Si—B—based intermetallic compound particle phase;

wherein the molybdenum alloy end product comprises Si between 0.05 mass % and 0.48 mass % and B between 0.04 mass % and 0.37 mass %;

wherein the coating film comprises at least one element selected from group 4A elements, group 3B elements, group 4B elements other than carbon, and rare earth elements of the periodic table or an oxide of at least one elements selected from the above-mentioned element groups and has a thickness of 10 μm to 300 μm on the surface of the molybdenum alloy end product; and wherein a crystal grain of the first phase has an aspect ratio which is representative of a ratio of a major axis and a minor axis of the crystal grain and which is 1.5 or more and 300 or less.

4. The coated member according to claim 3, wherein the coating film comprises at least one of $Al_2O_3$, $ZrO_2$, $Y_2O_3$, $Al_2O_3$—$ZrO_2$, $ZrO_2$—$Y_2O_3$, and $ZrO_2$—$SiO_2$.

5. A coated member comprising a molybdenum alloy end product having a surface and a coating film coated on the surface of the molybdenum alloy end product; wherein:

the molybdenum alloy end product comprises:

a first phase containing Mo as a main component; and a second phase which comprises 1 to 9 mass % of $Mo_5SiB_2$, in the molybdenum alloy end product as a Mo—Si—B—based intermetallic compound particle phase, wherein the molybdenum alloy end product comprises Si between 0.05 mass % and 0.48 mass % and B between 0.04 mass % and 0.37 mass %;

wherein the coating film comprises at least one element selected from group 4A elements, group 5B elements, group 6A elements, group 3B elements, and group 4B elements other than carbon of the periodic table or a carbide, a nitride, or a carbonitride of at least one elements selected from the above-mentioned element groups and has a thickness of 1 μm to 50 μm on the surface of the molybdenum alloy end product; and wherein a crystal grain of the first phase has an aspect ratio which is representative of a ratio of a major axis and a minor axis of the crystal grain and which is 1.5 or more and 300 or less.

6. The coated member according to claim 5, wherein a material forming the coating film contains at least one of TiC, TiN, TiCN, ZrC, ZrN, ZiCN, VC, VN, VCN, CrC, CrN, CrCN, TiAlN, TiSiN, and TiCrN.

* * * * *